US006123834A

United States Patent [19]

Kao et al.

[11] Patent Number: 6,123,834

[45] **Date of Patent: *Sep. 26, 2000**

[54] CATALYTIC UPGRADE OF NAPHTHA

[75] Inventors: Jar-Lin Kao, Houston; Henry M. Pogorzelski, Austin, both of Tex.

[73] Assignee: Exxon Chemical Patents Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/844,052

[22] Filed: Apr. 18, 1997

[51] Int. Cl.[7] ..... C10G 35/06; C10G 35/095

[52] U.S. Cl. ..... 208/135; 208/137

[58] Field of Search ..... 208/135, 137

[56] References Cited

U.S. PATENT DOCUMENTS

| | | | |
|---|---|---|---|
| 3,756,942 | 9/1973 | Cattanach | 20/137 |
| 3,843,741 | 10/1974 | Yan | 208/135 |
| 3,845,150 | 10/1974 | Yan et al. | 208/135 |
| 3,855,155 | 12/1974 | Morrison | 208/135 |
| 3,871,993 | 3/1975 | Morrison | 208/135 |
| 3,890,218 | 6/1975 | Morrison | 208/135 |
| 3,926,782 | 12/1975 | Plank et al. | 208/135 |
| 4,097,367 | 6/1978 | Haag et al. | 208/135 |
| 4,120,910 | 10/1978 | Chu | 260/673 |
| 4,157,293 | 6/1979 | Plank et al. | 208/135 |
| 4,175,057 | 11/1979 | Davies | 252/455 |
| 4,180,689 | 12/1979 | Davies et al. | 585/407 |
| 4,197,214 | 4/1980 | Chen et al. | 208/135 |
| 4,350,835 | 9/1982 | Chester | 585/415 |
| 4,490,569 | 12/1984 | Chu | 585/415 |
| 4,927,525 | 5/1990 | Chu | 208/138 |
| 4,933,310 | 6/1990 | Aufdembrink | 502/71 |
| 4,987,109 | 1/1991 | Kao | 502/66 |
| 5,202,513 | 4/1993 | Kanai | 585/407 |
| 5,574,199 | 11/1996 | Beck et al. | 585/407 |
| 5,609,751 | 3/1997 | Wall | 208/135 |

FOREIGN PATENT DOCUMENTS

| | | |
|---|---|---|
| 0325859 | 8/1989 | European Pat. Off. . |
| 0420326A1 | 4/1991 | European Pat. Off. . |
| 0466318 | 1/1992 | European Pat. Off. . |
| 2162534 | 2/1986 | United Kingdom . |
| WO91/06616 | 5/1991 | WIPO . |
| WO 9603209 | 2/1996 | WIPO . |
| WO96/03209 | 2/1996 | WIPO . |

OTHER PUBLICATIONS

Fukase et al., "Development of Light Naphtha Aromatization Process Using a Conventional Fixed Bed Unit", Catalysts in Petroleum Refining and Petrochemical Industries 1995, pp. 455–464, 1996.

Bhat et al., "n–Pentane aromatization over pore size regulated MFI zeolite: Enrichment of para–xylene content in xylenes", Applied Catalysis A: General 130, L1–L4, May, 1995.

*Primary Examiner*—Walter D. Griffin

*Attorney, Agent, or Firm*—James A. Zboray; Edward F. Sherer

[57] ABSTRACT

A process for reforming naphtha-containing hydrocarbon feedstreams is disclosed wherein a naphtha stream containing at least about 5 wt % of C9+ aromatics, at least about 25 wt % $C_5$ to $C_9$ aliphatic hydrocarbons and greater than 50 wt. ppm sulfur is contacted under reforming conditions with a bifunctional reforming catalyst, e.g. $H^+$ZSM-5, containing a dehydrogenation metal, e.g. zinc. The resulting reformate contains a higher ratio of $C_6$ to $C_9$ aromatics to $C_5$–$C_9$ aliphatic hydrocarbon which boil near the boiling point of $C_6$ to $C_8$ aromatics present in the reformate, thereby facilitating separation of these aromatics form the reformate.

15 Claims, No Drawings

CATALYTIC UPGRADE OF NAPHTHA

BACKGROUND OF THE INVENTION

1. Field of the Invention

This invention relates to a process for reforming a naphtha stream over a bifunctional, metal loaded aluminosilicate catalyst.

2. Description of Related Art

Naphtha streams emerging from some petrochemical refining processes generally comprise a mixture of $C_5$ to $C_{13}$ hydrocarbons which include about 15–40 wt % of $C_6$ to $C_{11}$ aromatic compounds and the balance mostly a mixture of $C_5$ to $C_{11}$ aliphatic hydrocarbons, including mixed paraffins and mixed olefins. The bulk of the naphtha stream, e.g. at least about 25 wt %, comprises $C_5$ to $C_9$ hydrocarbons, many of which boil near the boiling range of the benzene/toluene/xylene (BTX) fractions present in the naphtha. This makes it difficult to extract the more valuable BTX components from the naphtha by conventional distillation techniques. Therefore, a solvent extract process is required to purify the BTX component for chemical uses, which adds to the cost of recovery of BTX components. The naphtha stream from the refinery also contains sulfur contaminants such as elemental sulfur, alkyl sulfides and sulfur compounds such as benzothiophenes.

A conventional procedure for both upgrading the naphtha and removal of the sulfur is to subject the naphtha stream to hydrodesulfurization (HDS) wherein the stream is contacted at high temperatures and in the presence of hydrogen with a desulfurization catalyst such as a sulfided cobalt or nickel/molybdenum catalyst. In addition to sulfur removal, the HDS process results in some aromatization and cracking of the $C_5$–$C_9$ hydrocarbons present in the naphtha, thereby facilitating the ability to separate BTX components form the hydrorefined product. However, the HDS process consumes large quantities of hydrogen, e.g. up to 10,000 SCF/B, rendering it an expensive process. Nonetheless, it is desirable to remove sulfur because it tends to poison conventional catalysts which are used to reform naphtha, e.g. noble metal loaded aluminate or aluminosilicate catalysts.

It is also known in the art that HDS treated naphtha streams, either prior to or after removal of substantial quantities of the BTX fraction, can be subjected to catalytic reforming to further enhance the aromatics content of the naphtha. In a typical reforming process, the reactions include dehydrogenation, dehydrocyclization, isomerization, and hydrocracking. The dehydrogenation reactions typically include dehydroisomerization of alkylcyclopentanes to aromatics, the dehydrogenation of paraffins to olefins, the dehydrogenation of cyclohexanes to aromatics and the dehydrocyclization of acyclic paraffins and acyclic olefins to aromatics. The aromatization of the n-paraffins to aromatics is generally considered to be the most important because of the high octane rating of the resulting aromatic product. The isomerization reactions included isomerization of n-paraffins to isoparaffins, the hydroisomerization of olefins to isoparaffins, and the isomerization of substituted aromatics. The hydrocracking reactions include the hydrocracking of paraffins and hydrodesulfurization of any sulfur compounds remaining in the feed stock.

It is well known that several catalysts are capable of reforming petroleum naphthas and hydrocarbons that boil in the gasoline boiling range. Examples of known catalysts useful for reforming include platinum (optionally with the addition of rhenium or iridium) on an alumina support, platinum on zeolites of small pore size such as type X and Y (provided the reactants and products are sufficiently small to flow through the pores of the zeolites), and platinum on zeolite KL supports as disclosed in U.S. Pat. No. 4,987,109 and WO91/06616. Catalytic reforming of essentially sulfur-free aliphatic hydrocarbons using a zinc or gallium loaded ZSM-5 catalyst is also disclosed in U.S. Pat. Nos. 3,756,942, 4,180,689, 4,490,569 and 4,933,310, as well as by Fukase et al., "Catalysts in Petroleum Refining And Petrochemical Industries 1995," 1996, pp. 456–464. Catalytic reforming of a sulfur-free naphtha using a ZMS-5 catalyst loaded with both platinum and another metal such as zinc or gallium is disclosed in WO96/03209.

However, none of these references teach reforming of a naphtha stream which has not been desulfurized and which contains high concentrations of C9+ aromatics above about 5 wt %.

Accordingly, it is a primary object of this invention to provide a catalytic process for upgrading a naphtha stream which contains BTX aromatics and also at least 5 wt % of C9+ aromatics, at least 25 wt % of $C_5$ to $C_9$ aliphatic hydrocarbons and greater than 10 wt. ppm sulfur.

SUMMARY OF THE INVENTION

The present invention provides a process for reforming a naphtha hydrocarbon stream containing at least about 5 wt % of C9+ aromatics, at least about 25 wt % of $C_5$ to $C_9$ aliphatic or cycloaliphatic hydrocarbons and greater than 10 wt. ppm of sulfur comprising contacting said stream under reforming conditions with a bifunctional reforming catalyst comprising an intermediate pore size aluminosilicate support and a dehydrogenation metal selected from the group consisting of one or a mixture of gallium, zinc, indium, iron, tin, boron and oxides or sulfides thereof.

The reformate produced by the process of this invention contains a higher ratio of $C_6$ to $C_9$ aromatics compared to $C_5$ to $C_9$ aliphatic hydrocarbons boiling in the range of the BTX components of the reformate, thereby facilitating separation of the BTX components from the reformate.

The process also obviates the need to hydrofine the naphtha prior to reforming, thereby eliminating this step in the production of high yields of BTX chemicals from naphtha streams.

DETAILED DESCRIPTION OF THE INVENTION

Zeolites which may be used as molecular sieve support material for the catalyst of the present invention include intermediate pore size zeolites having an average pore size in the range of about 6 to 7 Angstroms and a $SiO_2/Al_2O_3$ ratio of at least 10. These include zeolites having a MFI, MEL, TON, MTT or FER crystalline structure. Preferred such zeolites include ZSM-5, silicalite (a high silica to alumina ratio form of ZSM-5), ZSM-11, ZSM-12, ZSM-21, ZSM-22, ZSM-23, ZSM-35 and ZSM-38, with ZSM-5 being most preferred. The zeolite is preferably used in its acidic form, e.g. HZSM-5. Where the zeolite, as synthesized, contains alkali or alkaline earth metal cations, these can be exchanged with ammonium cations, followed by calcination in air at 600° F.–1000° F. by techniques well known in the art to produce the acid form of the zeolite.

The dehydrogenation metal may be incorporated into the zeolite structure by any suitable method such as impregnation (incipient wetness method), ion exchange or in some cases, using a metal source to replace a portion of the aluminum during synthesis of the zeolite whereby the dehydrogenation metal becomes part of the zeolite framework structure. An example of a crystalline galloaluimino silicate having a ZSM-5 structure and its method of production is disclosed in U.S. Pat. No. 5,202,513.

In the preferred embodiment, the zeolite is impregnated with the metal by well known methods such as by contacting a solution of a metal salt dissolved in an aqueous or alcoholic medium with the zeolite particles for a period of time sufficient to allow the cations to penetrate the zeolite pore structure. Suitable salts include the chlorides and nitrates. After drying the resulting zeolite precursor, it is calcined at temperatures of 300° C.–600° C. for a period of 1–6 hours. In most cases, the metal will be present in the zeolite structure in the form of the oxide. If the zeolite is presulfided, the metal may be present also in the form of the sulfide. The preferred metal loading may range from about 0.1 to 10 wt %, most preferably from about 0.5 to 5 wt %.

The zeolite may be used in the catalytic process in its crystalline particulate form or it may be combined with 10–50 wt % of binder materials such as silica, alumina or various clay materials as is known in the art to form molded prills or extrudates. A zeolite such as MFI can also be used as the binder. The metal impregnation process described above may be carried out before or after the zeolite is composited with the binder.

In the preferred embodiment of the invention, the metal present in the zeolite consists essentially of one or a mixture of gallium, zinc, indium, iron, tin or boron metal compounds, and does not contain a noble metal such as platinum, platinum/rhenium or platinum/iridium which tend to be more sensitive to deactivation by sulfur poisoning and/or coke build-up under reforming conditions.

Typical naphtha feeds which may be processed in accordance with this invention are refinery products containing at least about 25 wt %, more usually at least about 35 wt %, and most usually at least about 50 wt % of $C_5$ to $C_9$ aliphatic and cycloaliphatic hydrocarbons such as olefins and paraffins, about 30–40 wt % of $C_6$ to $C_{13}$ aromatics, of which at least 5 wt %, more usually at least 10 wt % constitutes C9+ aromatics and roughly 10–20 wt % of which constitute $C_6$–$C_8$ aromatics (BTX). These naphtha feeds also contain up to 500 weight ppm sulfur and about 10–100 weight ppm of nitrogen compounds. The term "sulfur" as used herein refers to elemental sulfur as well as sulfur compounds such as organosulfides or heterocyclic benzothiophenes. Typical naphtha feeds processed in accordance with the invention contain greater than 10 wt. ppm, often at least 50 wt. ppm and more often at least 100 wt. ppm of sulfur up to about 500 wt. ppm of sulfur.

Typical examples of aliphatic hydrocarbons present in the naphtha stream include paraffins such as n-hexane, 2-methylpentane, 3-methylpentane, n-hepane, 2-methylhexane, 3-methylhexane, 3-ethylpentane, 2,5-dimethylhexane, n-octane, 2-methylheptane, 3-ethylhexane, n-nonane, 2-methyloctane, 3-methyloctane and n-decane, as well as corresponding $C_5$ to $C_9$ cycloparaffins. Typical olefins include 1-hexane, 2-methyl-1-pentene, as well as the heptenes, nonenes and octenes. Aromatics include benzene, toluene, xylenes as well as $C_9$ to $C_{11}$ aromatics.

The naphtha is upgraded by passing it through one or more catalyst beds positioned in a reforming reactor. Suitable reforming conditions are as follows:

| | General | Preferred |
|---|---|---|
| Temp (F.) | 400–1000 | 800–1000 |
| Pres(psig) | 50–300 | 50–300 |
| WHSV | 0.5–25 | 0.5–3 |
| H2/oil mol ratio | 0–10 | 1–10 |

The following examples are illustrative of the invention.

The catalyst used in Example 1 was prepared by impregnating 40.33 grams of calcined HZSM-5 powder with a solution of 2.76 grams of $Zn(NO_3)_2$ and 37.97 grams of water. After drying at 120° C. for 2 hours, the catalyst precursor was calcined at 500° C. for 4 hours to give a ZnO/HZSM-5 catalyst (ZnZSM-5). Other catalysts were prepared in similar fashion using gallium and silver salts.

EXAMPLE 1

A full range virgin low sulfur $C_5$–$C_{11}$ naphtha containing 81 wt % paraffins/olefins and 19 wt % aromatics was processed through a 1.5 wt % loaded Zn HZSM-5 catalyst at 932° F., 3 psig, 2 WHSV and 4 H2/feed mole ratio over a period of 26 hours. The resulting reformate had the composition shown in Table 1.

EXAMPLES 2–5

A CAT Naphtha feed containing $C_5$ to 430° F. boiling components was fed under reaction conditions set forth in Example 1 over four different catalysts as also shown in Table 1, including an unmodified HZSM-5 in Example 5. The feed contains 460 wt. ppm sulfur, 76 wt. ppm nitrogen, 38.1 wt % paraffins, 11.4% cycloparaffins, 16.1 wt % olefins and 34.4 wt % of aromatics, of which 14.3 wt % is BTX, 9.6 wt % is $C_9$ aromatics and 10.5 wt % is $C_{10}$ and $C_{11}$ aromatics which are not present in significant amounts in virgin naphtha.

TABLE 1

| | FEED | CAT | BTX | A9 | A10 | OLEFINS | $C_5$–$C_9$ | GAS |
|---|---|---|---|---|---|---|---|---|
| Ex. 1 | VIRGIN | ZnZSM5 | 41.7 | 4.2 | — | 9.6 | 12.3 | 31.7 |
| Ex. 2 | $C_5$-430F | ZnZSM5 | 44.1 | 7.6 | 1.8 | 19.3 | 17.9 | 9.3 |
| Ex. 3 | $C_5$-430F | GaZSM5 | 38.5 | 9.8 | 1.6 | 18.3 | 19.1 | 12.7 |
| Ex. 4 | $C_5$-430F | AgZSM5 | 34.7 | 8.5 | 2.1 | 23.4 | 20.2 | 11.1 |
| Ex. 5 | $C_5$-430F | H + ZSM5 | 33.1 | 8.3 | 2.3 | 27.3 | 19.1 | 9.9 |
| Ex. 6 | $C_5$-430F | ZnZSM5 | 44.6 | 8.7 | 1.8 | 7.8 | 14.4 | 22.5 |

As used in Table 1, BTX refers to benzene, toluene xylene mixture, $A_9$ and $A_{10}$ refer to $C_9$ and $C_{10}$ aromatics, olefins are $C_2$–$C_4$ olefins, $C_5$–$C_9$ are non-aromatic liquids (mixtures of olefins and paraffins) and Gas is $C_1$–$C_4$ paraffins.

As is evident from the Table, Example 1 uses a catalyst of this invention in conjunction with virgin naphtha, yielding excessive amounts of wasteful gas products in the reformate as compared with Examples 2 and 3. High yields of BTX are produced in Examples 2 and 3, with lesser yields using silver or unmodified catalyst in Examples 4 and 5. Also, the highest yields of lighter aromatics, e.g. BTX plus $A_9$, were achieved in Examples 2 and 3, i.e., 51.7% and 48.3% respectively, with significantly lower yields of such lighter aromatics achieved in Examples 1, 4 and 5, i.e., 45.9%, 43.2% and 41.4% respectively. The higher ratio of BTX and $A_9$ aromatics to $C_5$–$C_9$ liquids boiling close to BTX in Examples 2 and 3 as compared with Examples 4 and 5 renders the BTX more susceptible to extraction from the reformate.

EXAMPLE 6

This example demonstrates that the catalysts of this invention are surprisingly resistant to sulfur and nitrogen poisoning over long run lengths.

Example 2 was repeated except the $C_5$ - 430° F. naphtha was passed over the Zn ZSM-5 catalyst at 932° F., 50 psig, 1WHSV and 4 $H_2$/feed mole ratio. After 147 hours on oil, the catalyst was still active in spite of the sulfur/nitrogen present in the feed. The reformate at this point comprised 44.6% BTX, 8.7% $A_9$, 1.8% $A_{10}$, 7.8% $C_2$–$C_4$ olefins, 14.4% $C_5$–$C_9$ liquid and 22.5% $C_1$–$C_4$ gas, as also shown in Table 1.

What is claimed is:

1. A process for reforming a naphtha hydrocarbon stream containing at least about 10 wt % of C9+ aromatics, at least about 25 wt % of $C_5$ to $C_9$ aliphatic and cycloaliphatic hydrocarbons and greater than 10 wt. ppm of sulfur and boiling in the range of $C_5$ to 430° F. comprising contacting said stream under reforming conditions with a bifunctional reforming catalyst comprising an intermediate pore size crystalline aluminosilicate support impregnated with a dehydrogenation metal selected from the group consisting of one or a mixture of gallium, zinc, indium, iron, tin and boron.

2. The process of claim 1 wherein said naphtha stream contains at least about 35 wt % of said $C_5$ to $C_9$ aliphatic and cycloaliphatic hydrocarbons.

3. The process of claim 1 wherein said naphtha stream contains about 30 wt % of $C_6$ to $C_{13}$ aromatics.

4. The process of claim 1 wherein said aluminosilicate support comprises a zeolite having a MFI, MEL, TON, MTT or FER crystalline structure.

5. The process of claim 1 wherein said aluminosilicate support is a HZSM-5 zeolite.

6. The process of claim 1 wherein said metal is zinc.

7. The process of claim 1 wherein said crystalline aluminosilicate support comprises particles held together with a binder material.

8. The process of claim 1 wherein said catalyst consists essentially of said aluminosilicate support and said dehydrogenation metal.

9. The process of claim 1 wherein said reforming conditions comprise a temperature of 800–1000° F., a pressure of 50–300 psig, a weight hourly space velocity of 0.5–3.0 and a hydrogen to hydrocarbon molar ratio of 0–10.

10. The process of claim 9 wherein said hydrogen to hydrocarbon molar ratio is 1–10.

11. The process of claim 1 wherein said hydrocarbon stream contains at least 50 wt. ppm of sulfur.

12. The process of claim 11 wherein said hydrocarbon stream contains at least 100 wt. ppm of sulfur.

13. The process of claim 12 wherein said hydrocarbon stream contains at least 150 wt. ppm of sulfur.

14. A process for reforming a naphtha hydrocarbon stream boiling in the range of $C_5$ to 430° F. and containing at least 10 wt % of C9+ aromatics, at least about 25 wt % of $C_5$ to $C_9$ aliphatic and cycloaliphatic hydrocarbons and greater than 50 wt. ppm of sulfur, comprising contacting said stream under reforming conditions, including a temperature of 800° F. to 1000° F., pressure of 50 to 300 psi, a weight hourly space velocity of 0.5 to 3.0 and in the presence of hydrogen at a hydrogen to hydrocarbon molar ratio of 1 to 10, with a bifunctional $H^+$ZSM-5 catalyst impregnated with a zinc dehydrogenation metal to produce a reformate, and separating $C_6$ to $C_8$ aromatics from said reformate.

15. A process for reforming a naphtha hydrocarbon stream boiling in the range of $C_5$ to 430° F. and containing at least about 10 wt % of $C_9$+ aromatics, at least about 30 wt % of $C_6$ to $C_{13}$ aromatics, at least 35 wt % of $C_5$ to $C_9$ aliphatic and cycloaliphatic hydrocarbons and greater than 100 wt. ppm of sulfur, comprising contacting said stream under reforming conditions with a bifunctional reforming catalyst comprising an intermediate pore size crystalline aluminiosilicate support impregnated with a dehydrogenation metal selected from the group consisting of one or a mixture of gallium, zinc, indium, iron, tin and boron.

* * * * *